US006195811B1

(12) United States Patent
Dragovic

(10) Patent No.: US 6,195,811 B1
(45) Date of Patent: Mar. 6, 2001

(54) SPA COVER MOUNTING METHOD AND APPARATUS

(75) Inventor: Zeljko Dragovic, Vista, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/353,531

(22) Filed: Jul. 14, 1999

(51) Int. Cl.[7] ..... E04H 4/00
(52) U.S. Cl. ..... 4/498; 4/503
(58) Field of Search ..... 4/496, 498, 503; 248/205.3, 205.4, 220; 16/268, 271; 220/810, 831, 832, 836, 841, 848, 845

(56) References Cited

U.S. PATENT DOCUMENTS 4,154,362 * 5/1979 McKenney ..... 16/225
4,853,985 8/1989 Perry ..... 4/498
4,857,374 * 8/1989 Perry ..... 4/498
4,991,238 2/1991 Forrest ..... 4/498
5,048,153 * 9/1991 Wall et al. ..... 4/498
5,566,403 10/1996 Black et al. ..... 4/498
5,689,841 11/1997 Black et al. ..... 4/498
5,819,332 * 10/1998 Perry ..... 4/498

* cited by examiner

*Primary Examiner*—Henry J. Recla
*Assistant Examiner*—Tuan Nguyen
(74) *Attorney, Agent, or Firm*—Price and Gess

(57) ABSTRACT

A foam spa cover member is attached to a cover lifter apparatus using a plurality of brackets, each having a horizontal lip inserted into a respective slit in a side surface of the cover and a vertical plate engaging the side surface.

21 Claims, 4 Drawing Sheets

SPA COVER MOUNTING METHOD AND APPARATUS

BACKGROUND OF THE INVENTION

1. Field of the Invention

The subject invention relates to spas, whirlpools and the like and more particularly to methods and apparatus facilitating atttachment of spa cover lifters to foam spa covers or cover sections.

2. Description of Related Art

Conventional spa covers employ a foam core to reduce weight and to provide insulation. The foam is typically 1 ½ to 2 pound density foam. A typical portable spa cover includes two or more foam sections hinged together to permit folding alone the hinge line.

The foam core is typically encased in a plastic or fabric cover. A typical cover material is marine grade vinyl, which may be treated for U.V., mildew and low temperature stability. A polyethylene vapor barrier may also be heat sealed to the foam core to inhibit water saturation.

Cover lifter apparatus is also known which is designed to be attached to a spa to assist the user in lifting and storing the spa cover. Examples of such devices are disclosed in U.S. Pat. Nos. 4,991,278 and 4,853,985.

Direct attachment of a cover lifter to foam cover components poses problems because of the weakness of the foam and the considerable forces involved in lifting the cover. Such problems become particularly acute when the spa cover has been subjected to rain or snow, which considerably increases its weight.

SUMMARY OF THE INVENTION

According to the invention, attachment devices are provided which provide a secure and stable interface and mechanical connection between a spa cover lifter and a spa cover. The invention finds application with numerous types of cover lifters and cover designs.

BRIEF DESCRIPTION OF THE DRAWINGS

The just summarized invention will now be described in detail in conjunction with the drawings of which.

DETAILED DESCRIPTION OF THE PREFERRED EMBODIMENTS

The following description is provided to enable any person skilled in the art to make and use the invention and sets fourth the best modes contemplated by the inventor of carrying out his invention. Various modifications within the scope of the invention will remain readily apparent to those skilled in the art.

Figure 1:
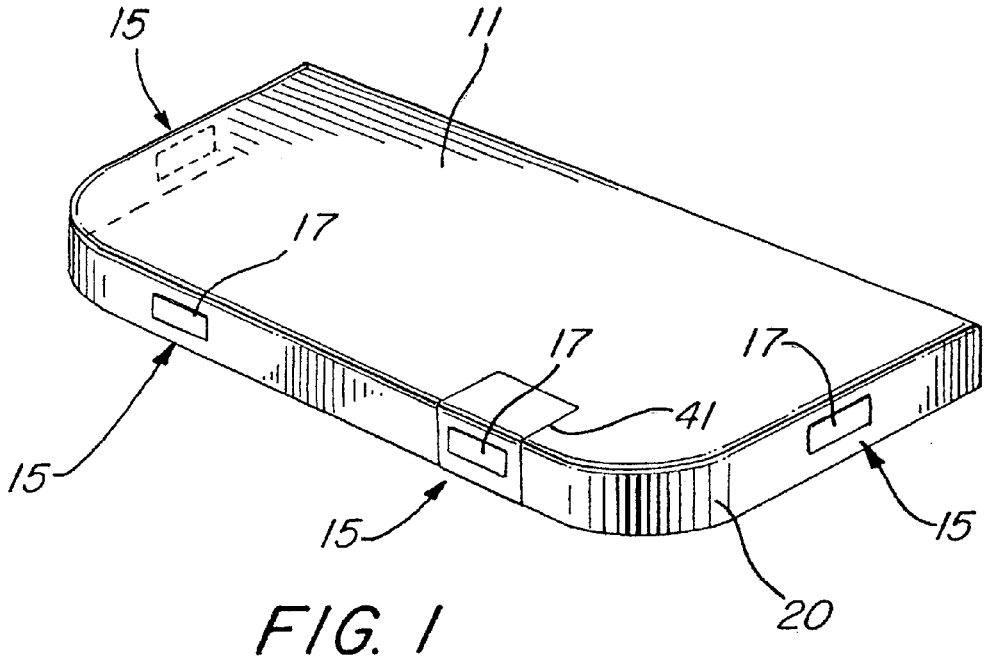
FIG. 1 is a perspective view illustrating a spa cover and cover lifter attachment apparatus according to the preferred embodiment of the invention.
Figure 2:
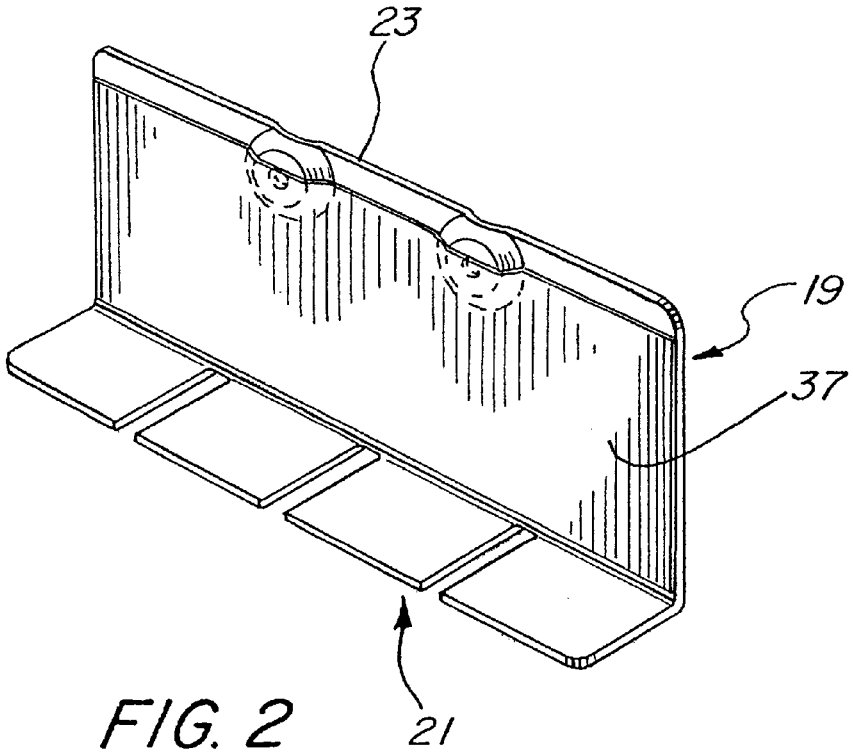
FIG. 2 is a perspective view of a preferred cover lifter attachment apparatus.
Figure 4:
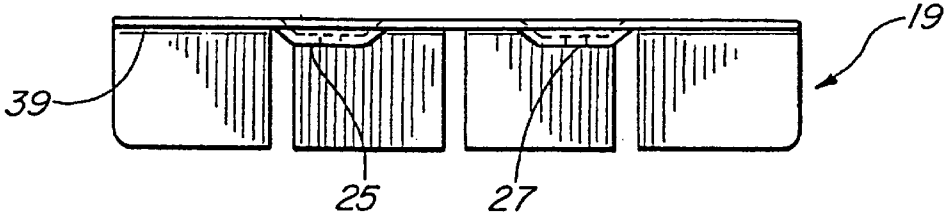
FIG. 4 is a top view of the apparatus of FIG. 3.
Figure 3:
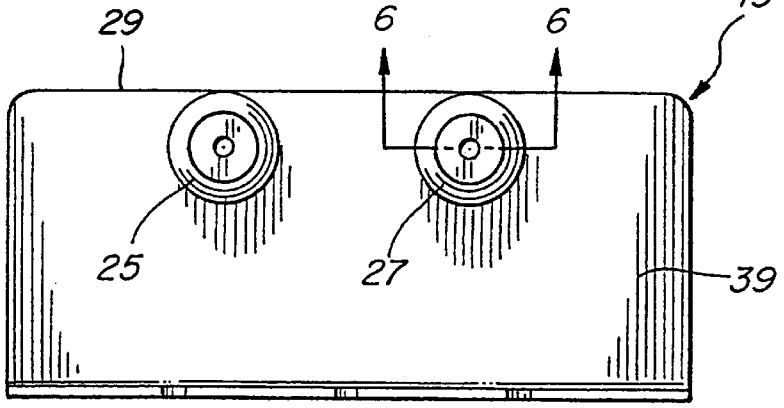
FIG. 3 is a front view of the apparatus of FIG. 2.

FIG. 1 illustrates a foam spa cover section 11 and cover lifter mounting apparatus according to the preferred embodiment. The particular foam cover section 11 is to be attached to arms or other componentry of a cover lifter device at foam attachment areas 15 on the side of the cover section 11. At each of these areas 15, cover lifter attachment devices 17 are positioned. Each attachment device 17 facilitates secure attachment of associated cover lifter componentry to the cover section 11.

A particularly preferred attachment device 17 comprises interface bracket 19 illustrated in FIGS. 2–6. The bracket 19 includes a horizontal serrated lip 21 integrally formed with a vertical plate 23. Lip 21 can be unserrated, if desired.

Figure 5:
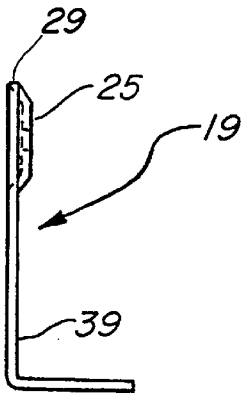
FIG. 5 is a side view of the apparatus of FIG. 3.
Figure 6:
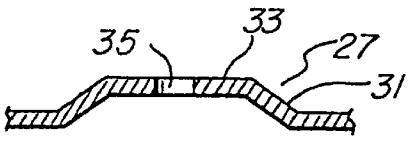
FIG. 6 is a sectional view taken at Section: A—A, at 6—6 of FIG. 3.

The vertical plate 23 has first and second protrusions or dimples 25, 27 formed adjacent its top edge 29. As seen in FIGS. 5 and 6, each of these dimples 25, 27 may have a conically shaped segment 31 leading to a flat circular portion 33 with a central hole 35 therein. The central holes 35 serve as pre-drilled pilot holes for subsequent attachment operations.

The bracket 19 may be formed from a single piece of metal, preferably, aluminum according to conventional metal forming procedures. Plastic of sufficient strength could also be used. An adhesive double sided release tape 37 is also applied to the inside surface 39 of the vertical plate 23. When the tape 37 is peeled off, the adhesive remains on the inside surface 39 to assist in attaching the bracket 19 to the side 20 of the foam cover section 11.

Figure 7:
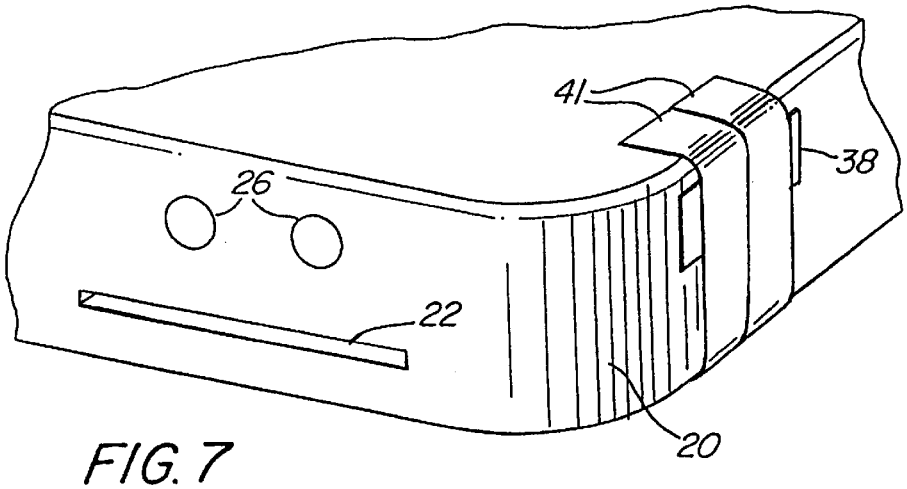
FIG. 7 is a partial perspective view of a portion of a spa cover illustrating a method of attachment of the apparatus illustrated in FIGS. 2, and 3–6.

The interface brackets 19 can be readily applied to the side surface 20 by forming conforming depressions 26 to receive the respective dimples 25, 27 and a horizontal slit or groove 22 to receive the horizontal lip 21 as illustrated in FIG. 7. Such slits and depressions are relatively easily cut and punched into the relatively soft foam side surface 20. Once the slits or depressions are formed, the release tape 37 is peeled off, the horizontal lip 21 is inserted into a receiving slit 22, and the adhesive bearing surface is pressed against the foam side 20. The dimples 25, 27 and lip 21 serve to maintain the bracket 19 in position with respect to the side surface 20. Once each bracket 19 is installed, vertically running strips 41 of adhesive tape may be further applied from the top surface of the cover section, down the side 20, over the outside surface 38 of the brackets 19 and against the bottom surface of the cover 11 to further secure retention of the brackets 19.

Once the brackets 19 are in place, a spa cover lifter device can be attached to the cover section 11. Such attachment may be achieved, for example, by insertion of screws or other mechanical fasteners through a lifter plate 66 (FIG. 8), through the skin covering the foam core, and into and through the metal surface of the vertical plate 23. Very stable mounting of cover lifter apparatus to a foam core cover is thereby facilitated.

Figure 8:
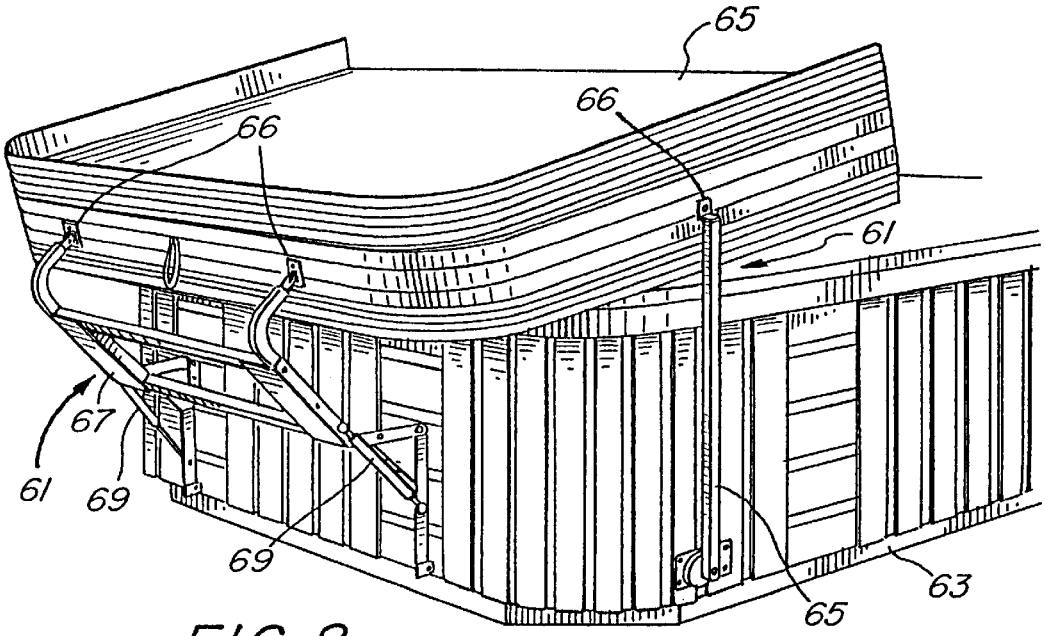
FIG. 8 (PRIOR ART)
FIG. 8 is a perspective view of an illustrative cover lifter apparatus.

In FIG. 8, a typical cover lifter device 61 is illustrated attached to a spa 63 and spa cover 65. The particular lifter 61 employs a pair of pivoting side arms, e.g., 65 and a pivoting back rack 67. The back rack 67 employs gas struts or springs 69 to provide a controlled smooth rotating action. It will be understood that cover lift 61 is but one of many cover lifter devices which can be attached to a cover according to the invention, and the particular cover lifter forms no part of the subject invention.

In FIG. 8, hinge plates 66 at the ends of the rack 67 and the arms 65 of the cover lifter are attached to cover 65 using attachment apparatus according to the invention. In the embodiment of FIG. 8, the attachment plate apparatus comprises brackets 19, which cooperate to facilitate assembly of the spa, cover and cover lifter according to a novel and useful procedure.

Figure 9:
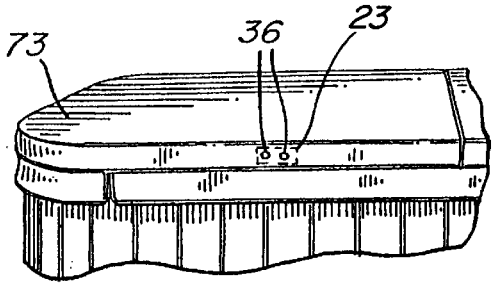
FIG. 9 is a side view of a portion of a spa cover.

In particular, the assembler may locate the vertical plates 23 which are concealed by the underlying vinyl 73 by feeling around the edge of the cover (see FIG. 9). The locations 36 of the underlying pilot holes 35 may then be located by further feeling around the plate 23. If desired, holes, aligned with the pilot holes, may be punched through the vinyl, using for example, a suitable metal punch tool. The hinge plates 66 may then be attached by inserting fasteners through the plate 66, 73 vinyl and pilot holes 35 and into the foam core. Additional fasteners may then be inserted through the hinge plates 66 and vertical plate 23. Suitable spacers may be used between the hinged plates 66 the vinyl and cover surface 73. As one example, four screws can be screwed through each hinge plate 66 and into a respective mounting bracket 19. A similar approach can be used to attach brackets, arms and similar components of various cover lifter apparatus to a foam spa cover member.

Figure 10:
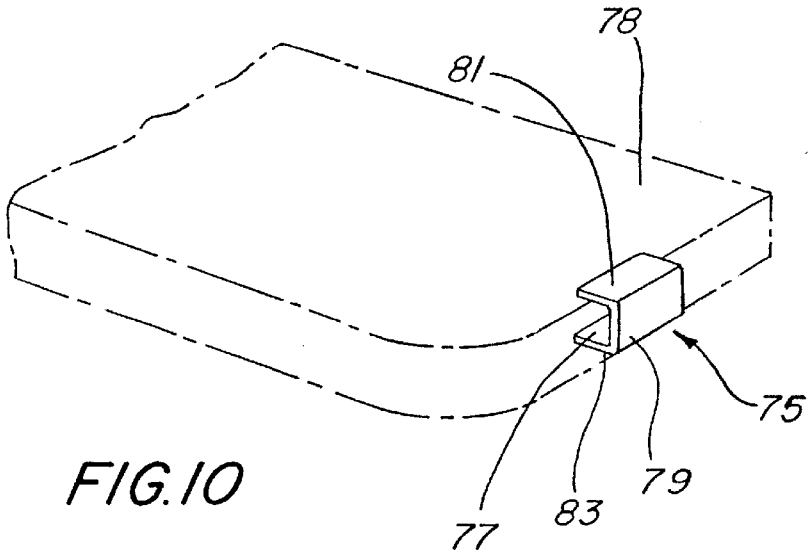
FIGS. 10, 11 and 12 are perspective views illustrating alternate embodiments.
Figure 11:
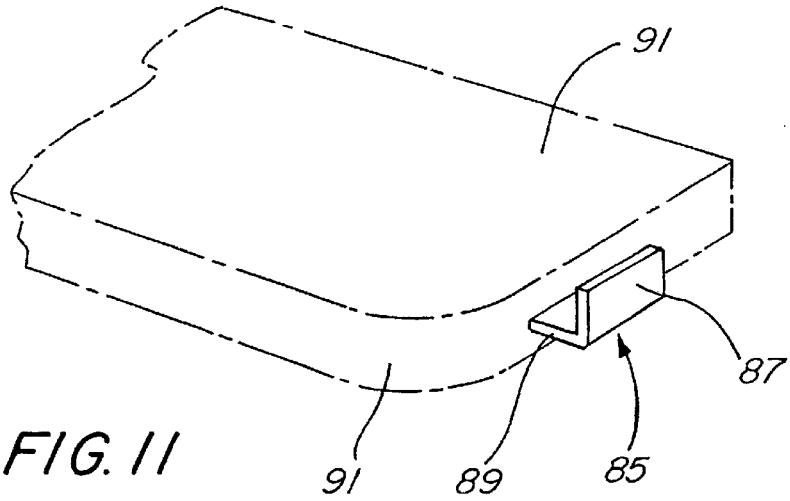
Figure 12:
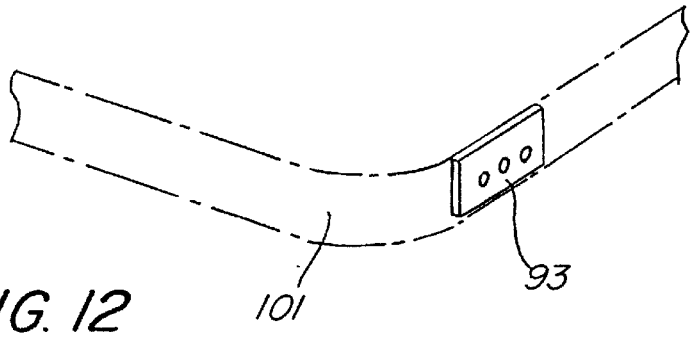

Alternative embodiments of the invention are illustrated in FIGS. 10–12. FIG. 10 illustrates a cover lifter attachment device 75 which forms a "C"-channel 77 sandwiching a spa cover 78. The "C"-channel in the embodiment of FIG. 10 is formed by vertical surface or plate 79, and respective upper and lower horizontal plates or surfaces 81, 83. As with various other embodiments, such a C-channel 77 may be affixed to the cover 77 by tape, adhesives, mechanical fasteners or a friction or "press-fit" clamping action. The C-channel 75 is preferably, but not necessarily a unitary metal or molded plastic piece.

FIG. 11 illustrates an L-shaped attachment device 85, formed of a vertical surface or plate portion 87 and a horizontal base or plate portion 89, which engages the under surface of a spa cover 91. FIG. 12 illustrates a side plate cover attachment device 93. Such a device 93 may be attached by one or more mechanical fastening elements or may have spikes formed on an inner surface thereof which penetrate a foam core 101. Again, adhesives or tape may also be used in securing attachment devices such as illustrated in FIGS. 11 and 12.

From the above descriptions those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An apparatus comprising:

a spa cover core having a preformed slit in a side surface thereof; and a cover lifter attachment device disposed against said side surface of said cover core, said attachment device comprising a bracket having a horizontal lip inserted into said slit and a vertical plate attached to said horizontal lip.

2. The apparatus of claim 1 wherein said spa cover core comprises foam.

3. The apparatus of claim 2 wherein said vertical plate is adhesively adhered to said side surface.

4. The apparatus of claim 1 wherein said bracket further includes a dimple formed as part of said vertical plate and extending into a depression in said side surface.

5. The apparatus of claim 4 further including a spa cover lifter component fastened to said vertical plate.

6. The apparatus of claim 5 wherein said vertical plate is adhesively adhered to said side surface.

7. The apparatus of claim 4 wherein said bracket is formed as a unitary aluminum part.

8. The apparatus of claim 1 further including a spa cover lifter component fastened to said plate.

9. The apparatus of claim 1 wherein said bracket is formed as a unitary aluminum part.

10. The apparatus of claim 1 wherein said horizontal lip comprises a flat rectangular solid member.

11. The apparatus comprising:

a foam spa cover core having a preformed slit in a side surface thereof; and means engaging said cover core for providing secure attachment of a spa cover lifter device to said cover core, said engaging means comprising a bracket having a horizontal lip inserted into said slit and a vertical plate attached to said horizontal lip.

12. The apparatus of claim 11 wherein said bracket further includes a dimple formed as part of said vertical plate and extending into a depression in said side surface.

13. The apparatus of claim 12 wherein said vertical plate is adhesively adhered to said side surface.

14. The apparatus of claim 12 wherein said bracket is formed as a unitary aluminum part.

15. The apparatus of claim 11 further including a spa cover lifter component fastened to said engaging means.

16. The apparatus of claim 11 further including a spa cover lifter component fastened to said bracket.

17. The apparatus of claim 16 wherein each said vertical plate is adhesively adhered to said side surface.

18. The apparatus of claim 11 wherein said bracket is formed as a unitary aluminum part.

19. The apparatus of claim 11 wherein said horizontal lip comprises a flat rectangular solid member.

20. A method of attaching a spa cover lifter to a spa cover core comprising the steps of:

providing a vertical plate having a horizontal lip formed thereon;

forming a horizontal slit in a side of said core;

inserting said horizontal lip into said horizontal slit; and attaching a part of said cover lifter to said vertical plate.

21. The apparatus of claim 20 wherein said horizontal lip comprises a flat rectangular solid member.

* * * * *

Dedication 6,195,811 — Zeljko Dragovic, Vista, CA. SPA COVER MOUNTING METHOD AND APPARATUS. Patent dated March 6, 2001. Dedication filed June 22, 2001, by the assignee, Watkins Manufacturing Corporation.

Hereby dedicates to the Public the entire term of said patent.

(*Official Gazette, May 14, 2002*)